United States Patent [19]

Rees

[11] Patent Number: 4,537,156

[45] Date of Patent: Aug. 27, 1985

[54] HEAT EXCHANGER HAVING A VERTICAL GAS FLUE

[75] Inventor: Karl Rees, Ruti, Switzerland

[73] Assignee: Sulzer Brothers Limited, Winterthur, Switzerland

[21] Appl. No.: 643,794

[22] Filed: Aug. 24, 1984

[30] Foreign Application Priority Data

Aug. 31, 1983 [CH] Switzerland ..... 4773/83

[51] Int. Cl.[3] ..... F22B 37/20

[52] U.S. Cl. ..... 122/6 A; 122/235 A; 122/235 K; 165/168

[58] Field of Search ..... 122/6 A, 235 A, 235 D, 122/235 K; 165/168, 169

[56] References Cited

U.S. PATENT DOCUMENTS

| | | | |
|---|---|---|---|
| 3,105,466 | 10/1963 | Evans | 122/235 A |
| 3,354,870 | 11/1967 | Darlinger | 122/235 A |
| 3,395,677 | 8/1968 | Brandstetter | 122/235 A |
| 4,245,588 | 1/1981 | Gill et al. | 122/6 A |
| 4,394,849 | 7/1983 | Pratt | 122/235 K |

*Primary Examiner*—Edward G. Favors

*Attorney, Agent, or Firm*—Kenyon & Kenyon

[57] ABSTRACT

The heat exchanger is constructed with a vertical gas flue and a hopper at the bottom end of the flue. The gas flue is shaped to have more than four sides. The hopper walls meet the wall-forming tubes of the gas flue around a boundary edge which extends over the entire periphery of the gas flue. All of the wall-forming tubes of the gas flue are bent at the boundary edge while the tubes in the walls of the hopper extend in parallel relationship to one another.

11 Claims, 12 Drawing Figures

HEAT EXCHANGER HAVING A VERTICAL GAS FLUE

This invention relates to an heat exchanger having a vertical gas flue.

As is known, heat exchangers such as steam generators frequently have a vertical gas flue and a hopper at the bottom end of the gas flue. In such cases, the gas flue usually consists of interconnected medium-carrying wall-forming tubes which extend substantially longitudinally of the gas flue. In a similar manner, the hopper is usually constructed of interconnected medium-carrying and wall-forming tubes while also having an outlet opening for ash or the like. In addition, the hopper walls usually meet the wall-forming tubes of the gas flue along a boundary edge at the top end of the hopper walls with the tubes of the hopper walls being connected with the gas flue tubes on the medium side.

In one known construction, the gas flue has a rectangular or square cross-section while the hopper consists of two inclined and two vertical hopper walls; the tubes of the vertical hopper walls being rectilinear continuations of the tubes of the gas flue. On the other hand, the tubes of the two inclined hopper walls are bent at the boundary edge to merge into the gas flue tubes. In this construction, the outlet opening of the hopper as disposed in a horizontal plane and is of the same length as one width of the gas flue while being relatively narrow. Further, the outlet opening extends in the middle of the gas flue parallel to the sides of the flue.

Gas flues of cylindrical cross-section are also known. In this case, two diametrically opposed wall parts of the cylindrical gas flue equal in width to the hopper outlet opening extend unchanged as far as the hopper outlet opening while the remaining wall parts of the cylinder extend so to taper spatially so that upon reaching the bottom hopper end, these walls form the straight long sides of the hopper outlet opening. However, since the peripheral lengths of these latter wall parts are longer than the long side of the outlet opening, a number of tubes have to be bent step wise outwardly from the hopper wall and taken to special headers. As a result, the hopper shape is very complex spatially of the resulting high costs of fabrication are a barrier to a practical application.

It is also known for the hopper configuration to depart from the conventional rectangular outlet opening shape and for the hopper to be in the form of a frusto-pyramid or frusto-cone with a square or round outlet opening. Because of the tapering of the hopper wall, the webs of the hopper walls have to be wedged-shaped in those instances where webs are used to connect the hopper tubes. Further, some of the hopper tubes have to be bent out of the hopper wall before reaching the outlet opening. These tubes are then taken to special annular headers. However, a practical execution of this construction is not favorable. Further one additional disadvantage of such a hopper is that the hopper readily clogs if large quantities of solid deposits fall to the outlet opening.

Other gas flue constructions are also known from coal gasification. In this instance, the hopper is reversed so that a cooled pyramid or a cooled cone with an upwardly directed apex is disposed at the outlet ends of the gas flue in concentric relation. In this case, an annular gap is formed between the pyramid or cone base and the gas flue outlet edge so that residues, such as ash are allowed to run through the gap into an annular rotating stripper. However, one of the disadvantages of this construction is that it is difficult to combine the structure with conventionally available disposal means because of the annular gap for removing the residues. An even more serious disadvantage is the fact that access to the annular gap is difficult should a breakdown or clogging occur. Thus, this type of construction is usually unsatisfactory.

Accordingly, it is an object of the invention to provide an improved vertical gas flue and hopper arrangement.

It is another object of the invention to provide a gas flue having more than four sides with a hopper in a relatively simple and inexpensive manner.

It is another object of the invention to provide a vertical gas flue and hopper arrangement which can be readily combined with conventional means for disposal of residues.

It is another object of the invention to provide a vertical gas flue and hopper arrangement which can be readily used with removal installations and coal-fired vapor generators.

Briefly, the invention provides a heat exchanger which is comprised of a vertical gas flue having a plurality of vertically disposed sides which define at least a pentagonal cross-section and a hopper below the gas flue having walls defining an outlet opening at a lower end.

Each side of the gas flue includes a plurality of interconnected medium-carrying wall-forming tubes which extend longitudinally of the sides while each wall of the hopper includes a plurality of parallel interconnected medium-carrying wall-forming tubes. In addition, each tube of the hopper is connected to a respective tube of the gas flue along a boundary edge which extends over the entire periphery of the gas flue with each tube of the gas flue being bent at the boundary edge.

The construction of the heat exchanger results in simple and readily supervised tube arrangements in the hopper walls.

Particular advantages of the construction are as follows:

The gas flue and hopper arrangement can be applied unrestrictively to prismatic flues with more than four side surfaces, irrespective of whether the number of surfaces is odd or even numbered, and even to cylindrical gas flues. Further, it is possible to construct hoppers for gas flues having an irregular pentagonal cross-section. In addition, the technology known for rectangular section gas flues can be used for the production of the gas flue.

Since all the gas flue tubes can be bent at the boundary edge between the gas flue and hopper, all of the hopper walls may have flat surfaces. This, together with the readily supervised tube arrangement, allows for an inexpensive manufacture.

These and other objects and advantages of the invention all become more apparent from the following detailed description. Taken in conjunction with the accompanying drawings wherein.

Figure 1:
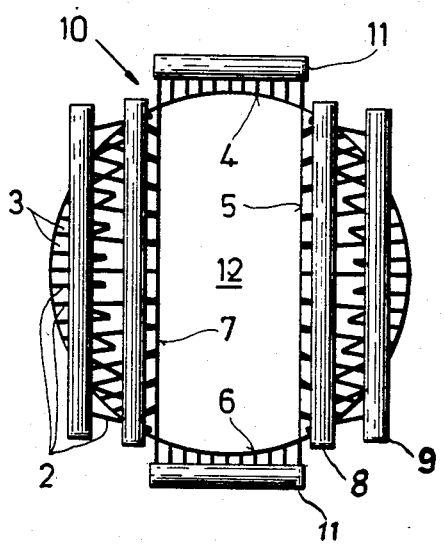
FIG. 1 illustrates a view taken line I—I of FIG. 2 of a known heat exchanger employing a circular gas flue.
Figure 2:
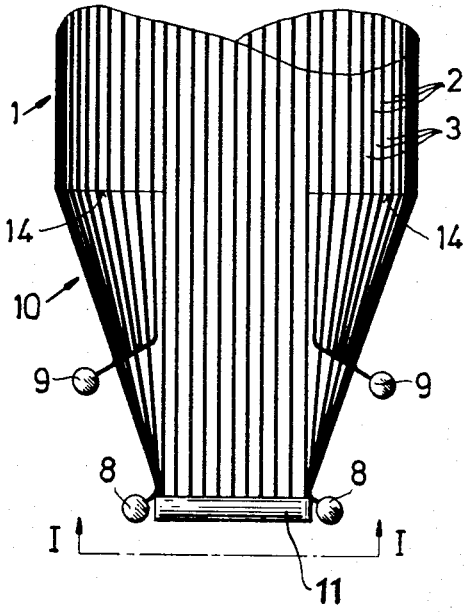
FIG. 2 illustrates a front view of the circular gas flue and hopper arrangement to FIG. 1.
Figure 11:
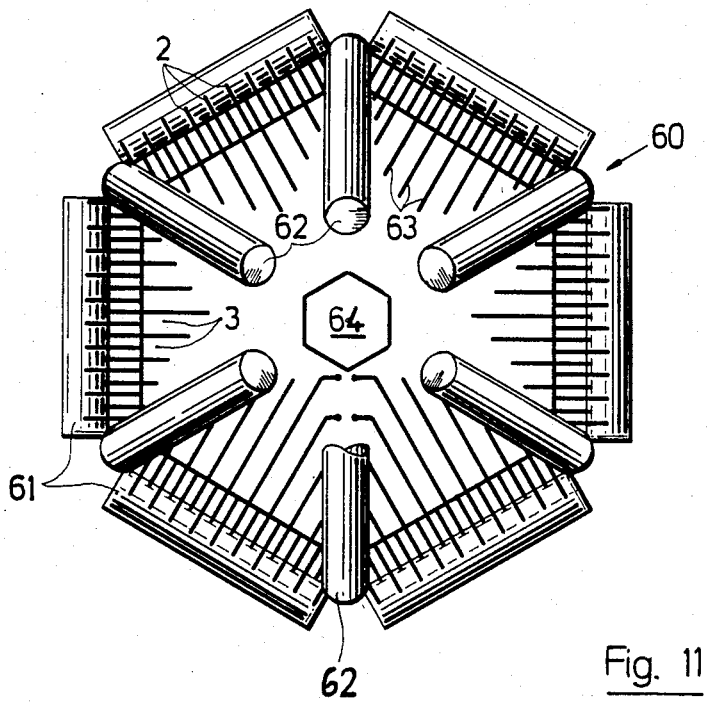
Figure 12:
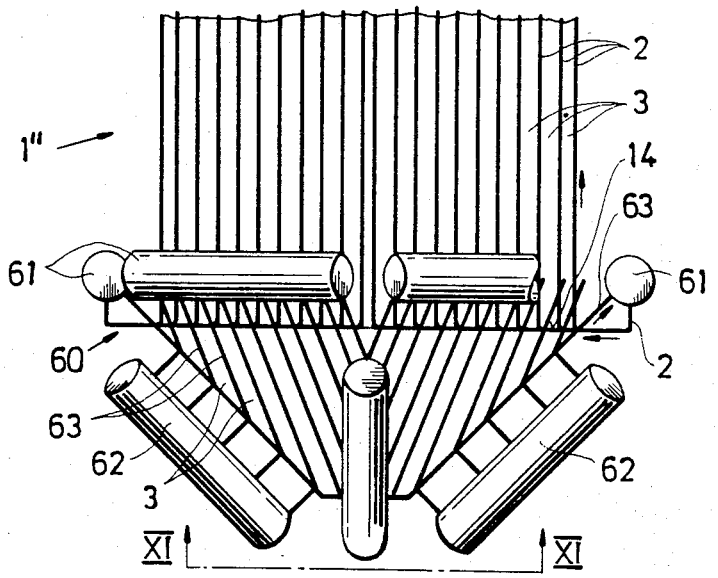

FIG. 11 illustrates a view taken on line XI—XI of FIG. 12 of a modified arrangement according to the invention; and FIG. 12 illustrates a front view of the gas flue and hopper arrangement of FIG. 11. and Referring to FIGS. 1 and 2, it has been known to construct a heat exchanger of a cylindrical gas flue 1 from wall tubes 2 which are welded together via webs 3 so to be gas-tight. It has also been known to connect the gas flue 1 to a hopper 10 formed by extensions of the wall tubes 2 and of the web 3, again welded together in gas-tight relation. In this instance, the hopper 10 consists of four walls 4–7 (see FIG. 1). Two walls 4,6 are of the same length as the width of an outlet opening 12 of the hopper 10 and are in alignment with corresponding wall parts of the gas flue 1. The other two walls 5,7 of the hopper walls are formed by the gas flue webs 3 and wall tubes 2 which are bent inwards at a boundary edge 14. Since the walls 5,7 are longer at the boundary edge 14 than at the hopper opening 12, the webs 3 gradually taper downwardly and some of the tubes 2 are bent outwardly before reaching the hopper opening 12 and are taken to a header 9. The other tubes of the walls 5,7 are connected to headers 8 while the walls of the tubes 4,6 are connected to headers 11. The geometric complexity of this form of hopper has been noted above. Further, the resulting very complex manufacturing operations can be determined from viewing FIGS. 1 and 2.

Figure 3:
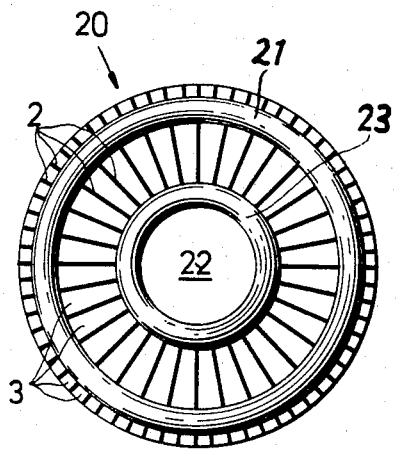
FIG. 3 illustrates a view taken on line III—III of FIG. 4 of a further known cylindrical gas flue and hopper arrangement.
Figure 4:
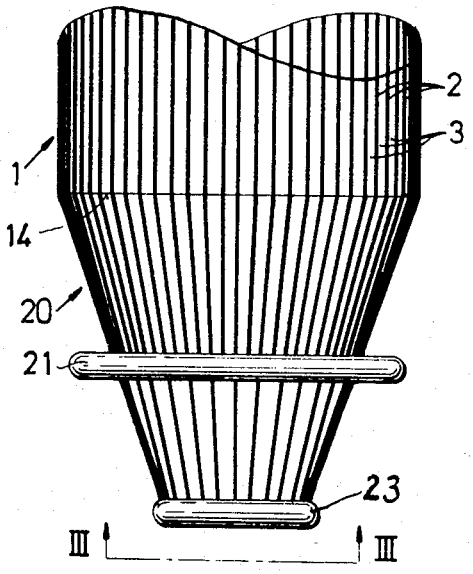
FIG. 4 illustrates a partial front view of the exchanger FIG. 3.

Referring to FIGS. 3 and 4, wherein like reference characters indicate like parts as above, it has also been known to provide a cylindrical gas flue 1 with a conical hopper 20. In this case, all the wall tubes 2 and webs 3 are bent inwardly at the boundary edge 14 to form the hopper 20. Because of the different length of the periphery at the boundary edge 14 and at the outlet opening 22 of the hopper 20, the webs 3 again have to taper towards the outlet opening 22 while some of the wall tubes 2 of the hopper 20 have to be bent out before reaching the outlet opening 22. As indicated, these tubes lead into an annular header 21 while the other tubes are connected to an annular header 23 surrounding the opening 22. Compared with the construction shown in FIGS. 1 and 2, the construction of FIGS. 3 and 4 has the advantage that all the webs 3 are cut the same way and they reach the hopper 20 and all the wall tubes 2 are bent in the same way at the boundary edge 14. Nevertheless, the construction is very complex to manufacture, particularly for gas flues of large cross-section Further, the risk of the outlet openings 22 clogging is considerable.

Figure 5:
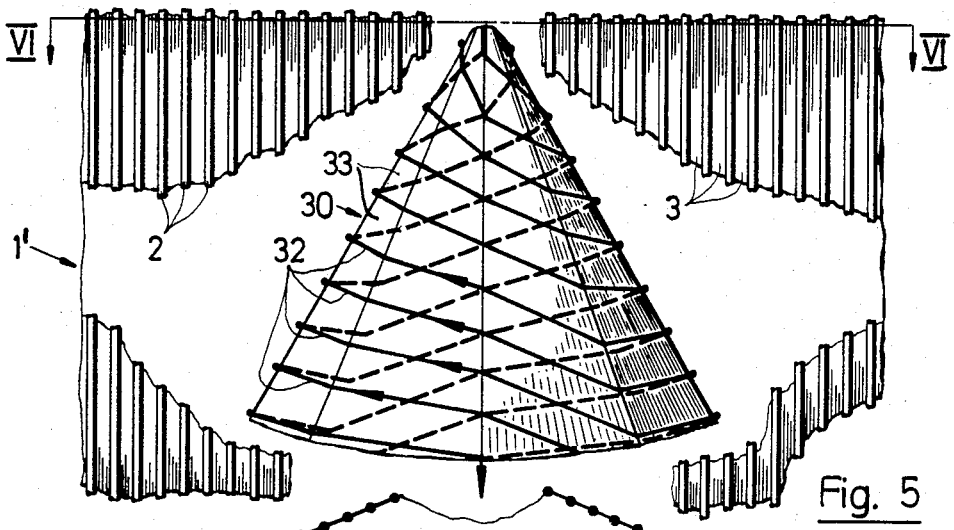
FIG. 5 illustrates a partially broken away view of a further known gas flue and hopper arrangement.
Figure 6:
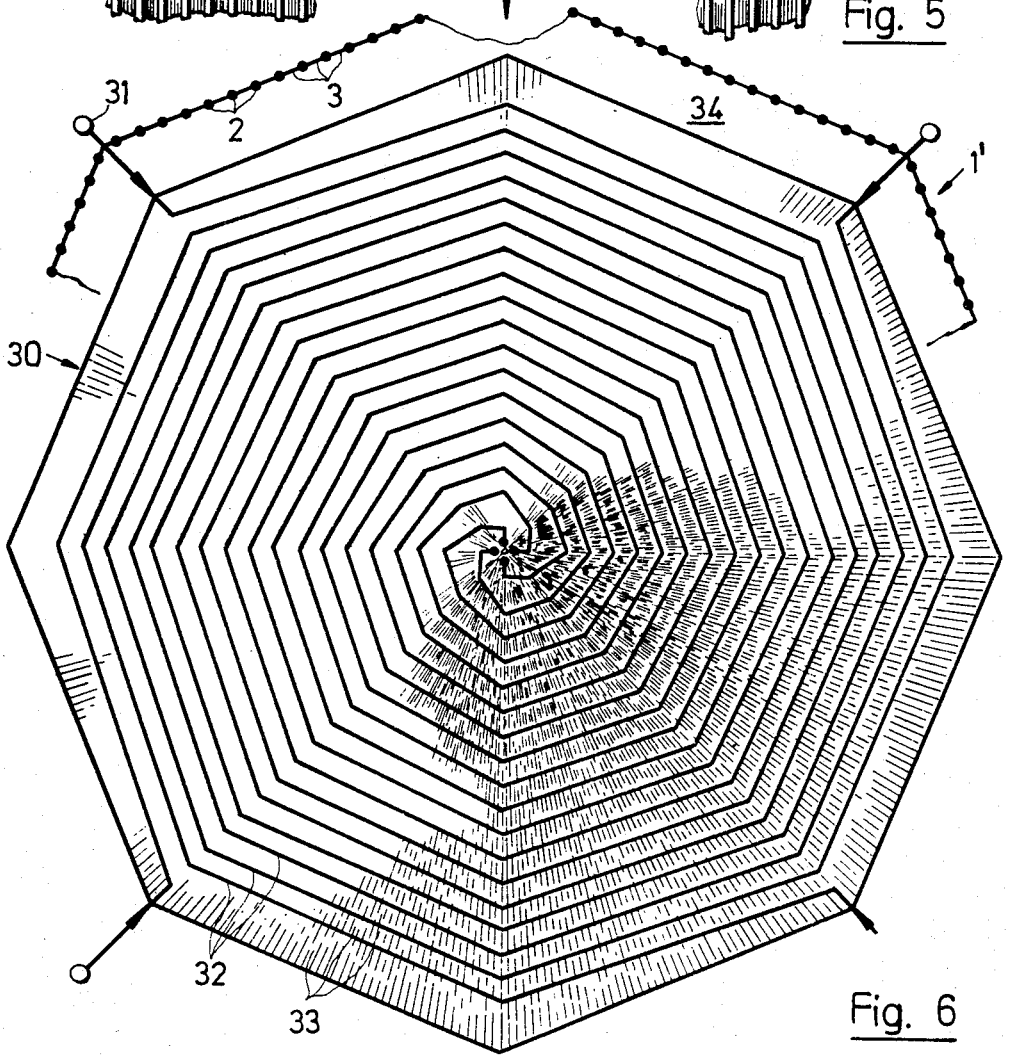
FIG. 6 illustrates a view taken on line VI—VI of FIG. 5.

Referring to FIGS. 5 and 6, wherein like reference characters indicate like parts as above, it has also been known to provide a vertical prismatic gas flue 1', for example having an octagonal cross-section with an upwardly tapering pyramid 30. As indicated in FIG. 5, the pyramid 30 projects from below into the gas flue 1'. The base of the pyramid 30 is an octagon disposed parallel to the cross-section of the gas flue 1' and concentrically thereto as indicated in FIG. 6. The base is situated at approximately the same vertical plane as the bottom edge of the gas flue 1'.

The pyramid 30 is formed by four medium-carrying tubes 32 which extend parallel to the sides of the octagon and, thus, basically have the form of broken three-dimensional spirals welded together to be gas-tight by means of webs 33. In the region of the apex of the pyramid 30, the tubes 32 are bent inwards and taken vertically down to below the base of the pyramid 30 and from there to connections (not shown). At the base of the pyramid 30, the tubes 32 are bent outwards and each leads into a header 31. The medium preferably flows from the headers 31 through the tubes 32 of the pyramid 30 up and then down from the apex of the pyramid 30 and, finally, to the connections. The medium can alternatively flow in the reverse direction. The liquid or solid residues accumulating inside the gas flue 1' drop down and are guided by the pyramid 30 and the walls of the gas flue to a substantially annular outlet opening 34 from which they fall into a rotating stripper (not shown). Although it is not excessively complex to manufacture a structure of this kind, problems arise in connection with the fact that accessibility is difficult, as stated above, in the event of breakdowns and clogging. It is also difficult to provide a connection to the commercially available disposal devices.

Figure 7:
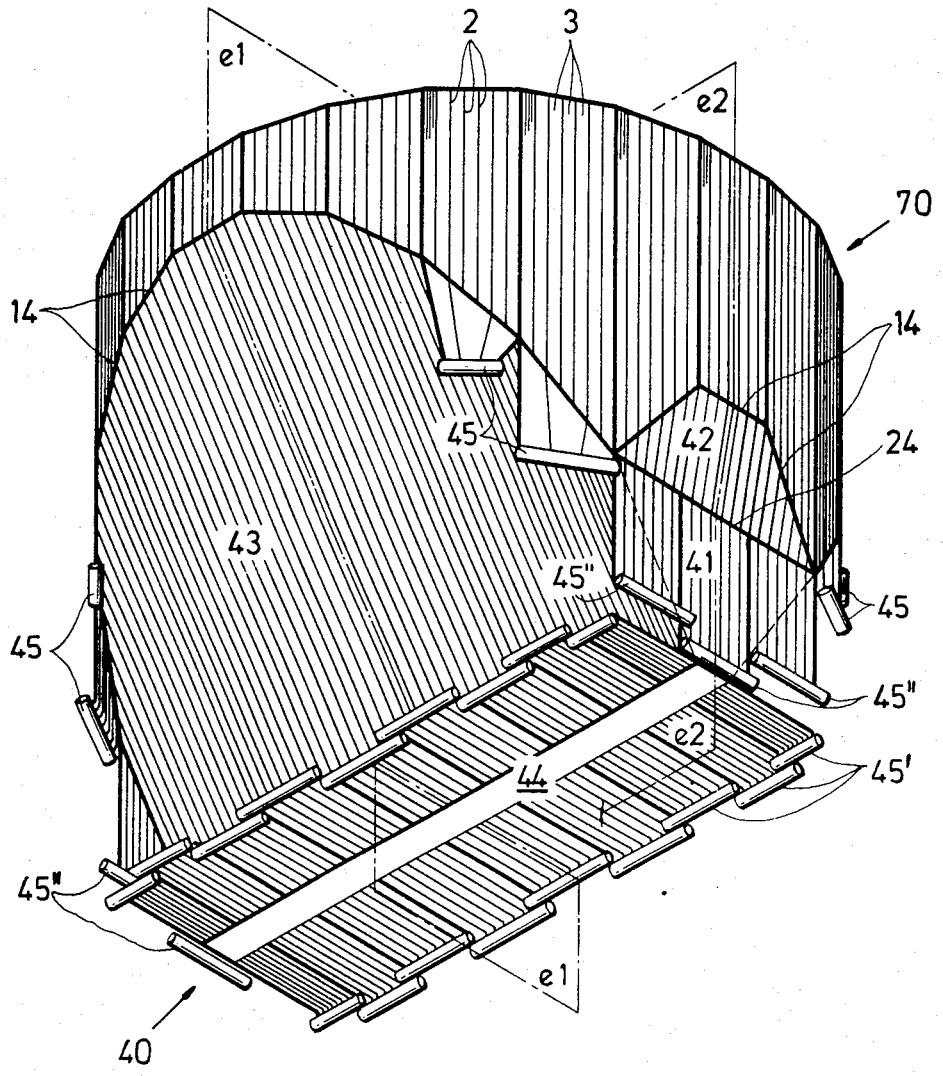
FIG. 7 illustrates a perspective view of a gas flue and hopper arrangement according to the invention.

Referring to FIG. 7, the heat exchanger is constructed of a vertical gas flue 70 having a plurality of vertically disposed sides defining at least a pentagonal cross-section, for example a prism comprising twenty four equal sides. Each side includes a plurality of interconnected medium-carrying wall-forming tubes 2 which extend longitudinally of the flue sides, i.e. vertically. These tubes 2 are welded together via webs 3 so as to be gas-tight.

In addition, the heat exchanger has a hopper 40 which is connected below and to a bottom end of the gas flue 70 along a boundary edge 14. The hopper consists basically of six flat walls 41, 42, 43, only three of which are shown. Of these, two vertical walls 41 define the short sides of an outlet opening 44 while two inclined walls 43 define the long sides of the outlet opening 44. As such, the opening 44 has an oblong shape. The remaining walls 42 are each inclined and are connected to the vertical walls 41 along a horizontal edge 24 and the sides of the gas flue 70.

Each wall 41, 42, 43 of the hopper includes a plurality of parallel interconnected medium-carrying wall-forming tubes which are formed as extensions of the wall tubes 2. Further, webs which are extensions of the webs 3 of the gas flue are also welded to the tubes in the hopper 40 so as to render the hopper walls gas-tight.

As indicated in FIG. 7, each tube of the hopper 40 is connected to a respective tube 2 of the gas flue 70 along the boundary edge 14 which extends over the entire periphery of the gas flue 70 with each tube of the gas flue 70 being bent at the boundary edge 14.

The boundary edge 14 has a broken configuration which depends on which side of the gas flue 70 coincides with the hopper 40. If the boundary edge 40 is perpendicular to the longitudinal axis of the wall tubes 2, the tube pitch in the adjacent wall part of the hopper 40 remains constant. The more the angle between the boundary edge 14 and the longitudinal axis of the wall tubes 2 in the gas flue 70 deviates from a right angle, the closer the pitch of the tubes 2 bent into the hopper wall in this wall part of the hopper 40. If the pitch in a part of the hopper wall were to be smaller than the outside diameter of the wall tubes 2, then some of the wall tubes 2 in the flue 70 are bent out at the boundary edge 14 and taken to headers 45 as is the case at the six places illustrated in FIG. 7.

As shown in FIG. 7, eighteen headers 45' are provided in the plane of the outlet opening 44 of the hopper 40 for all the tubes of the two inclined walls 43. Additional headers, 45'', i.e. six are also provided for the tubes of vertical walls 41.

A vertical imaginary reference plane e1 extends between the two vertical walls 41 in parallel and symmetrical relationship thereto, and a vertical imaginary reference plane e2 extends at right angles thereto and divides the vertical walls 41 into two identical parts. All the wall tubes 2 in the two inclined walls 43 extend parallel to the reference plane e1, the number of tubes on either side of the plane e1 being equal. Similarly, all the wall tubes 2 in the two vertical and inclined walls 41, 42 extend parallel to the reference plane e2, the number of tubes on either side of plane e2 again being equal.

Any solid or liquid materials dropping inside the gas flue 70 are thus fed continuously by the hopper 40 to the outlet opening 44, via which they reach means (not shown) in which they are then treated further. A heat-transfer medium, e.g. a heat-absorbing medium, flows through the wall tubes 2.

Figure 8:
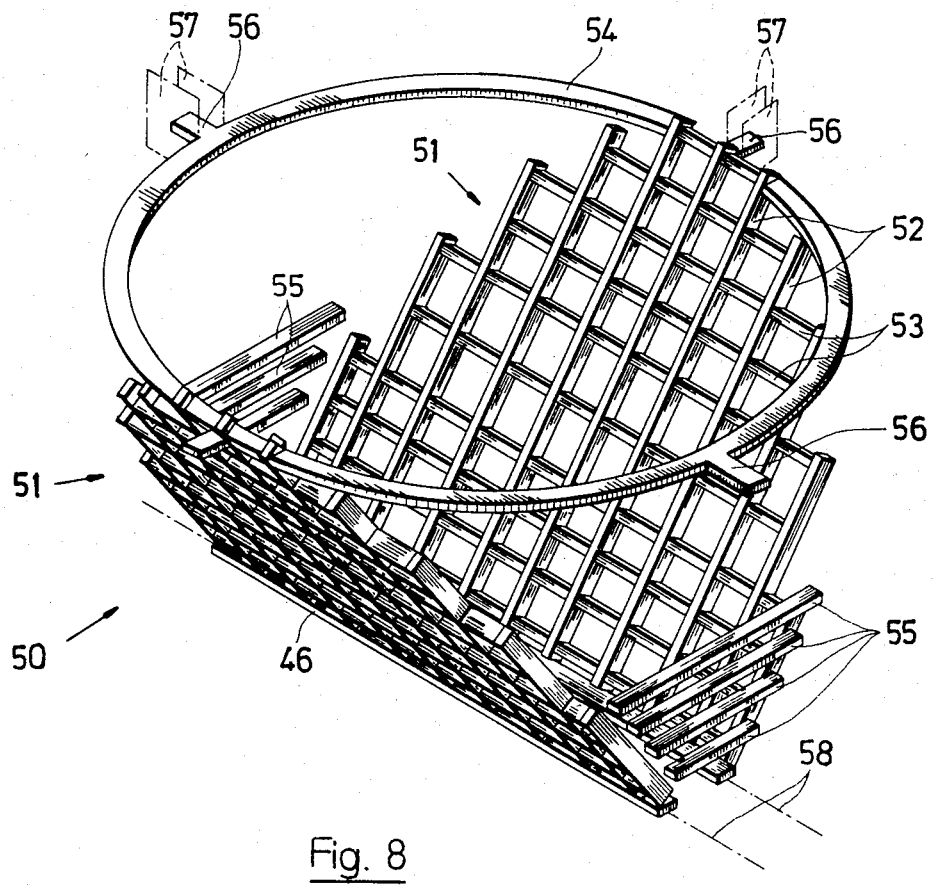
FIG. 8 illustrates a perspective view of a support structure for reinforcing the hopper of the arrangement of FIG. 7.

Referring to FIG. 8, for gas flues having a very large cross-section, the hopper (not shown) is reinforced by a support structure 50 in order to take on mechanical loads, particularly, flexural loads of the inclined walls 43 to thus safeguard the shape of the hopper. In order to prevent any stresses due to different thermal expansion between the gas flue and the hopper, the support structure 50 is slidably connected to the hopper walls.

The support structure 50 includes a pair of support grids 51 each of which consists of inclined members 52 and horizontal members 53. In addition, the support structure 50 has a support ring 54 which is rigidly connected to the top end of the two support grids 51. Still further, the support structure 50 has a plurality of auxiliary members 55 which extend parallel to the plane e1 (see FIG. 7).

Each grid 51 extends parallel to a respective inclined hoppper wall 43 and is pivotally mounted on a horizontal axis 58 located at the bottom and adjacent to the hopper outlet opening 44. In addition, the support ring 54 is disposed about the gas flue 70 adjacent an upper edge of the hopper 40 while being displacable longitudinally of the gas flue 70. The support ring 54 is so dimensioned to a pre-calculated deformability so as to be in the form of an ellipse in a non-loaded condition. The major axis of the ellipse extends substantially parallel to the longitudinal direction of the outlet opening 44. In normal operation, the support ring 54 has a circular shape and, under very considerable loading, for example in the event of explosions inside the hopper 40, assumes a shape of an ellipse with a major axis extending perpendicularly to the longitudinal direction of the hopper outlet opening 44.

The auxiliary members 55 are provided to support the vertical walls 41 of the hopper, particularly to prevent outward deflection. These auxiliary members 55 are so connected in known manner to the walls as to ensure mutual freedom of movement horizontally both in response to loads and in response to thermal expansion.

As illustrated in FIG. 8, the support ring 54 has four lugs 56 disposed in circumferentially spaced apart relation about the periphery. Each lug 56 is, in turn, guided between two guide plates 57 of a support frame (not shown). The cooperation of the lugs 56 on the guide plates 57 enables the support ring 54 to perform vertical movements and undergo deformation along two axes, one of which is parallel and the other of which is perpendicular to the longitudinal direction of the outlet opening 44. However, horizontal shifting of the support ring 54 is prevented.

The gas flue 70 and hopper 40 are connected to the support ring 54 by known connecting plate systems which allow both vertical movements of the support ring 54 and different thermal expansions of the interconnected parts, while preventing major deflections of the gas flue 70, for example, in the event of an earthquake.

Figure 9:
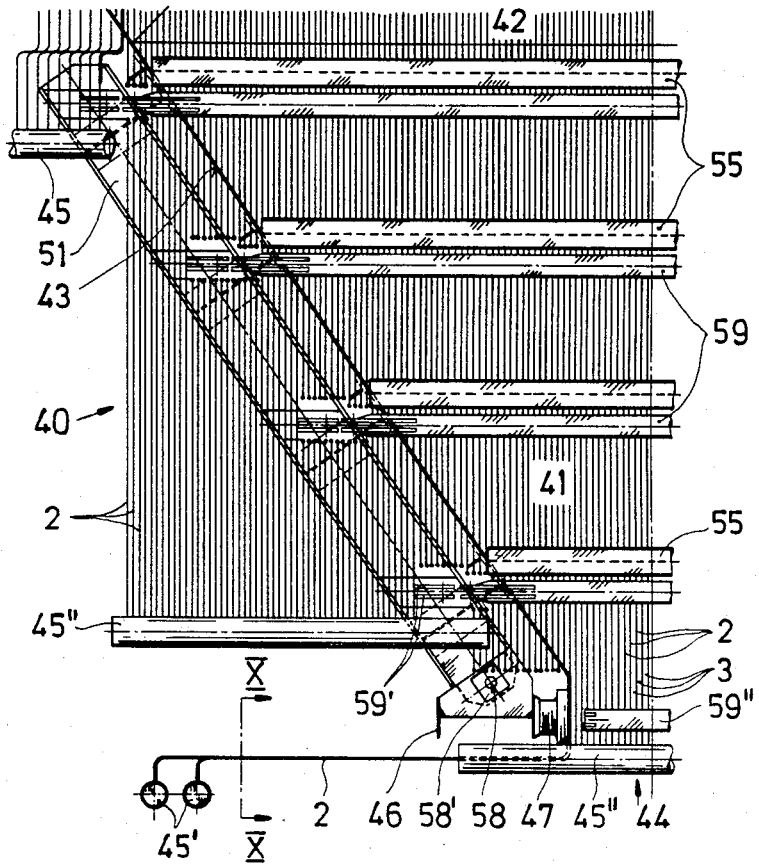
FIG. 9 illustrates a detail view of the arrangement of FIG. 7 and the support structure of FIG. 8 in accordance with the invention.
Figure 10:
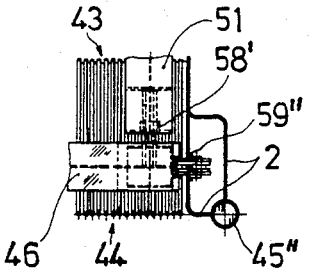
FIG. 10 illustrates a view taken on line X—X of FIG. 9.

Referring to FIGS. 9 and 10, the support structure 50 is connected to the hopper 40 in a bottom zone of the hopper 40. To this end, the two vertical walls 41 of the hopper 40 are reinforced by tie rods 59 in addition to the auxiliary members 55. The tie rods 59 are also connected to the support grids 51 at the corners by connecting plates 59'. At the bottom ends, the support grids 51 are provided with joints 58' on which the pivot axes 58 are disposed. In addition the support grids 51 are mounted on two horizontal members 46 which extend parallel to the longitudinal direction of the outlet opening 44. Consequently, the grids 51 can pivot slight about the associated pivot axis 58 in order to take thermal expansion of the hopper 40 or deformation due to internal loading; the support ring 54 undergoing slight deformation under these conditions.

The vertical walls 41 are additionally reinforced near the outlet opening 44 by a tie rod 59'' while the two inclined walls 43 are reinforced by members 46 secured thereto via connecting boxes 47.

Referring to FIG. 10, the wall tubes 2 are bent to create a space for a known plate connection between the members 46, on the one hand, and the tie rods 59'', on the other hand. This also applies to the plate connections between the tie rods 59 and the support grids 51.

The support structure 50 may have a temperature very different from the hopper 40. However, this has no adverse effect because of the structure used to equalize the different thermal expansions, as explained above. The support structure 50 also has sufficient flexibility to take on mechanical loads produced by deformation of the walls 41. Of note, because of these small dimensions and favorable configuration, the inclined walls 42 have no extra reinforcement.

Referring to FIGS. 11 and 12, in another embodiment, the heat exchanger has a vertical gas flue 1'' which has a plurality of vertically disposed sides defining a hexagonal cross-section with each side including a plurality of vertically interconnected medium-carrying tubes 2. In addition, a hopper 60 is connected to the flue 1'' and includes a plurality of walls which define a hexagonal frusto-pyramid shape with a hexagonal outlet opening 64 at a lower end.

As above, the wall tubes 2 of the gas flue 1'' are welded together by webs 3 to be gas-tight. At the boundary edge 14 (see FIG. 12) the webs 3 are bent inwards and then extend into the walls of the hopper 60. The tubes 2 of the gas flue 1'', on the other hand still extend vertically somewhat beyond the boundary edge 14 and are then bent out through 90°, whereupon the tubes lead into intermediate headers 61 after again being bent through an angle of 90°. There is a total of six intermediate headers 61, i.e. one for each side of the hexagon.

The hopper walls each consist of a plurality of parallel interconnected medium-carrying tubes 63 and webs 3 which are bent at the boundary edge 14 and which are welded to the tubes 63 to be gas-tight. The tubes 63 extend perpendicularly to the intermediate header 61 and lead at the boundary edge 14 into the hopper wall. Thus, in each of the six downwardly tapering walls, the tubes 63 extend parallel to one another as far as the edge between two adjoining hopper walls. At these edges, the tube 63 are bent outwardly from the hopper wall and are taken to hopper headers 62. As indicated, there are six headers 62 extending parallel to the edges of the hopper 60.

If the gas flue is part of the vapor generator, the working medium first flows through the headers 62 and then through the tubes 63 of the hopper 60. The medium then flows into the intermediate headers 61 and then down into the wall tubes 2 of the gas flue 1''. The reverse flow sequence is possible, particularly if the gas flue with the hopper serves a gas heater.

Advantageously, the headers 61 and/or 62 are so constructed and connected to the tubes as to achieve mixing of the medium flowing there through. This provides a uniform medium condition.

The arrangement of the gas flue 1'' and hopper 60 has a particular advantage in being very simple to manufacture. However, the arrangement is suitable only for readily flowing deposits because of the small outlet opening 64.

Of note, the arrangement in FIGS. 11 and 12 can be modified so that the intermediate headers 61 are omitted.

Of further note, the hopper 40 shown in FIG. 7 can be formed so as to have a square outlet opening 44 so that the vertical walls 41 with the headers 45'' and the headers 45 above the outlet 44 can be eliminated.

What is claimed is:

1. A heat exchanger comprising a vertical gas flue having a plurality of vertically disposed sides defining at least a pentagonal cross-section, each said side including a plurality of interconnected medium-carrying wall-forming tubes extending longitudinally of said sides;

a hopper below said gas flue having walls defining an outlet opening at a lower end, each said wall including a plurality of parallel interconnected medium-carrying wall-forming tubes; and each said tube of said hopper being connected to a respective tube of said gas flue along a boundary edge extending over the entire periphery of said gas flue with each tube of said gas flue being bent at said boundary edge.

2. A heat exchanger as set forth in claim 1 which further includes a plurality of headers, each said header being connected to at least some of said tubes of said gas flue below said boundary line.

3. A heat exchanger as set forth in claim 1 wherein said walls of said hopper define an outlet opening of oblong shape disposed in a horizontal plane, said walls including inclined walls having bottom edges defining two long sides of said outlet opening and top edges at said boundary edge.

4. A heat exchanger as set forth in claim 3 wherein said hopper includes two vertical walls having bottom edges defining two short sides of said outlet opening and two inclined walls extending respectively from a top edge of said vertical walls to said boundary edge.

5. A heat exchanger as set forth in claim 1 which further comprises at least one header at said boundary edge connecting at least some of said gas flue tubes with said hopper tubes.

6. A heat exchanger as set forth in claim 5 wherein said header is constructed as a mixer for the medium flowing therethrough.

7. A heat exchanger as set forth in claim 1 which further comprises a support structure for reinforcing said hopper, said support structure including a pair of grids and a support ring connected to said grids, each said grid being pivotedly mounted on a respective horizontal axis adjacent said hopper outlet opening and said support ring being disposed about said gas flue adjacent an upper edge of said hopper while being displaceable longitudinally of said flue.

8. A heat exchanger comprising a vertical gas flue having a plurality of vertically disposed sides defining at least a pentagonal cross-section, each said side including a plurality of vertical interconnected medium-carrying tubes, and a hopper below and connected to said flue along a peripheral boundary edge, said hopper including a plurality of walls defining an oblong-shaped hopper outlet opening at a lower end, each said wall including a plurality of parallel interconnected medium-carrying tubes, each said hopper tube being connected to a respective flue tube to convey medium therebetween.

9. A heat exchanger as set forth in claim 8 wherein said hopper has a pair of inclined walls defining two long sides of said outlet opening and two vertical walls defining two short sides of said outlet opening.

10. A heat exchanger as set forth in claim 9 where said hopper has an inclined wall between and connected to a respective vertical wall and said gas flue.

11. A heat exchanger comprising a vertical gas flue having a plurality of vertically disposed sides defining a hexagonal cross-section, each said side including a plurality of vertical interconnected medium-carrying tubes;

a hopper connected to said flue and including a plurality of walls defining hexagonal frusto-pyramid shape with a hexagonal outlet opening at a lower end, each said wall including a plurality of parallel interconnected medium-carrying tubes;

a plurality of intermediate headers, each said header being connected to said tubes of a respective side of said flue, and said tubes of a respective wall of said hopper, and a plurality of hopper headers, each said hopper header being connected to said tubes of two adjoining hopper walls adjacent an edge therebetween.

* * * * *

UNITED STATES PATENT AND TRADEMARK OFFICE

CERTIFICATE OF CORRECTION

PATENT NO. : 4,537,156

DATED : August 27, 1985

INVENTOR(S) : Karl Rees

It is certified that error appears in the above-identified patent and that said Letters Patent is hereby corrected as shown below:

Column 1, line 27 change "as" to -is-

Column 1, line 44 change "of" to -and-

Column 3, line 6 change "Fig. 5." to -Fig. 5;-

Column 3, line 16 change "Fig. 9." to -Fig. 9;-

Column 3, line 22 change "Fig. 11 and" to -Fig. 11; and-

Column 3, line 25 change "so to" to -so as to-

Signed and Sealed this

*Eleventh* Day of *February 1986*

[SEAL]

*Attest:*

DONALD J. QUIGG

*Attesting Officer*

*Commissioner of Patents and Trademarks*